US011432702B2

(12) United States Patent
Heinle et al.

(10) Patent No.: US 11,432,702 B2
(45) Date of Patent: Sep. 6, 2022

(54) DOMESTIC DISHWASHER HAVING LIFTING MECHANISM FOR WASHING ITEM RECEPTACLE

(71) Applicant: BSH Hausgeräte GmbH, Munich (DE)

(72) Inventors: Martin Heinle, Glött (DE); Florian Racs, Heidenheim (DE); Martin Rittner, Welden (DE); Thomas Steck, Holzheim (DE); Norbert Gerstner, Herbrechtingen (DE)

(73) Assignee: BSH Hausgeräte GmbH, Munich (DE)

( * ) Notice: Subject to any disclaimer, the term of this patent is extended or adjusted under 35 U.S.C. 154(b) by 283 days.

(21) Appl. No.: 16/616,996

(22) PCT Filed: May 28, 2018

(86) PCT No.: PCT/EP2018/063867
§ 371 (c)(1),
(2) Date: Nov. 26, 2019

(87) PCT Pub. No.: WO2018/233979
PCT Pub. Date: Dec. 27, 2018

(65) Prior Publication Data

US 2021/0121042 A1 Apr. 29, 2021

(30) Foreign Application Priority Data

Jun. 20, 2017 (DE) ..... 10 2017 210 310.8

(51) Int. Cl.
*A47L 15/50* (2006.01)

(52) U.S. Cl.
CPC ..... *A47L 15/506* (2013.01); *A47L 15/507* (2013.01)

(58) Field of Classification Search
CPC ..... A47L 15/506; A47L 15/507
See application file for complete search history.

(56) References Cited

U.S. PATENT DOCUMENTS 7,731,805 B2 * 6/2010 Banta ..... A47L 15/506 134/56 D
2012/0074080 A1 * 3/2012 Garcia ..... F24C 15/168 211/41.9

(Continued)

FOREIGN PATENT DOCUMENTS

DE 1020152017564 A1 10/2015
WO WO-2008038320 A1 * 4/2008 ..... A47L 15/506

(Continued)

OTHER PUBLICATIONS

International Search Report PCT/EP2018/063867 dated Aug. 27, 2018.

*Primary Examiner* — Joseph L. Perrin
*Assistant Examiner* — Irina Graf
(74) *Attorney, Agent, or Firm* — Michael E. Tschupp; Andre Pallapies; Brandon G. Braun

(57) ABSTRACT

A household dishwasher includes a rinsing container, a washing item receptacle, a guide mechanism for moving the washing item receptacle from a starting state within the rinsing container to an end state outside the rinsing container and vice versa, and a lifting mechanism for raising the receptacle from a starting position to an end position and to lower it from the end position to the starting position. The lifting mechanism includes a lifting lever pivotably connected to the rinsing container and the guide mechanism and having a guide contour for arresting the receptacle in the end position when lifted from the starting position to the end position and in the end state when lowered from the end position to the starting position so that the receptacle is only movable from the starting state to the end state in the starting position and vice versa.

18 Claims, 12 Drawing Sheets

(56) References Cited

U.S. PATENT DOCUMENTS

| | | | | |
|---|---|---|---|---|
| 2015/0305493 | A1 | 10/2015 | Garcia et al. | |
| 2017/0164733 | A1 * | 6/2017 | Azkue | A47B 46/005 |

FOREIGN PATENT DOCUMENTS

| | | | | |
|---|---|---|---|---|
| WO | 2015185631 | A1 | 12/2015 | |
| WO | 2016008678 | A1 | 1/2016 | |
| WO | WO-2016131775 | A1 * | 8/2016 | A47B 88/60 |

* cited by examiner

DOMESTIC DISHWASHER HAVING LIFTING MECHANISM FOR WASHING ITEM RECEPTACLE

CROSS-REFERENCES TO RELATED APPLICATIONS

This application is the U.S. National Stage of International Application No. PCT/EP2018/063867, filed May 28, 2018, which designated the United States and has been published as International Publication No. WO 2018/233979 A1 and which claims the priority of German Patent Application, Serial No. 10 2017 210 310.8, filed Jun. 20, 2017, pursuant to 35 U.S.C. 119(a)-(d).

BACKGROUND OF THE INVENTION

The present invention relates to a household dishwasher.

A dishwasher has a rinsing container and at least one washing item receptacle which is movable into and out of said rinsing container. In particular, such a dishwasher may have a plurality of washing item receptacles which are arranged on top of one another, such as for example a lower basket, an upper basket or a cutlery drawer. Since the lower basket is arranged in the vicinity of a bottom of the rinsing container, in order to load or unload the lower basket it is necessary for the user to kneel or bend down toward the lower basket.

The publication DE 10 2014 213 986 A1 discloses a household dishwasher having a rinsing container, having a washing item receptacle, having a lifting mechanism which is designed to raise the washing item receptacle from a starting position to an end position and to lower the washing item receptacle from the end position to the starting position, and having a guide mechanism by means of which the washing item receptacle can be moved from a starting state arranged within the rinsing container to an end state arranged outside of the rinsing container and vice versa, wherein the lifting mechanism comprises a lifting lever connected in a pivoting manner to the rinsing container and the guide mechanism, as well as a guide contour which is designed to arrest the washing item receptacle in the end position when the washing item receptacle is raised from the starting position to the end position and in the end state when said washing item receptacle is lowered from the end position to the starting position, so that the washing item receptacle can only be moved from the starting state to the end state in the starting position and vice versa.

The publication DE 10 2014 210 721 A1 discloses a dishwasher having a body, at least one loading plane, at least one guide rail, along which the at least one loading plane is movable in a linear manner, at least one control arm which pivotably holds the at least one guide rail on the body, wherein the control arm is pivotably articulated on the guide rail about a pivot axis, an arresting piece which is arranged on the at least one loading plane and an arresting counterpiece which is arranged on the control arm, wherein the arresting piece and the arresting counterpiece in a released state thereof release a linear movement of the at least one loading plane along the at least one guide rail and in an arrested state thereof arrest a linear movement of the at least one loading plane along the at least one guide rail, wherein the arresting piece or the arresting counterpiece is rotatable about a rotational axis respectively in the other of the arresting piece or the arresting counterpiece for an adjustment thereof between the arrested state and the released state, wherein the rotational axis is arranged along the same axis as the pivot axis of the at least one control arm.

The publication DE 10 2012 107 993 A1 discloses a sliding-pivoting mechanism of a rack of an item of furniture or household appliance for withdrawing and raising the rack from a body of the item of furniture, having at least two pivot arms which are rotatably fixed to at least one of the side walls of the body with a first end parallel to the plane of the side walls and which are arranged spaced apart in parallel to one another, wherein a guide rail is pivotably fixed to the respective second ends of the pivot arms parallel to the plane of the side walls, such that the guide rail is pivotable from a lower position inside the body into a raised upper position at least partially outside the body, and at least one running rail, to which the rack is fastened and which is movable in a linear manner in the guide rail on at least one of the side walls of the body, wherein the sliding-pivoting mechanism has an arresting mechanism, which is arranged on the guide rail and on one of the pivot arms for preventing a simultaneous pivoting and sliding movement of the running rail, by being arrested in the raised state.

BRIEF SUMMARY OF THE INVENTION

In view of this background to the invention, an object of the present invention is to provide an improved household dishwasher.

Accordingly, a household dishwasher is proposed. The household dishwasher has a rinsing container, a washing item receptacle for receiving items to be washed, a lifting mechanism which is designed to raise the washing item receptacle from a starting position to an end position and to lower the washing item receptacle from the end position to the starting position, a guide mechanism, by means of which the washing item receptacle can be moved from a starting state arranged within the rinsing container to an end state arranged outside of the rinsing container and vice versa, wherein the lifting mechanism comprises a lifting lever connected in a pivoting manner to the rinsing container and the guide mechanism, said lifting lever having a guide contour which is designed to arrest the washing item receptacle in the end position when same is lifted from the starting position to the end position and in the end state when same is lowered from the end position to the starting position so that the washing item receptacle can only be moved from the starting state to the end state in the starting position and vice versa.

Thus it is reliably ensured that the washing item receptacle is only movable into and out of the rinsing container when it is located in the starting position. As a result, a collision of the washing item receptacle with a further washing item receptacle received in the rinsing container may be reliably prevented. As the guide contour is provided, no additional components such as for example levers, springs, arresting elements or the like are required in order to arrest the washing item receptacle. As a result, the lifting mechanism may be less complex. Consequently, the household dishwasher may be produced cost-effectively. The loading and unloading of the washing item receptacle is facilitated by means of the lifting mechanism, since the washing item receptacle may be raised to this end.

The washing item receptacle is, in particular, a lower washing item receptacle or a lower basket. The household dishwasher may also have in addition to the lower washing item receptacle an upper washing item receptacle or an upper basket and a cutlery drawer arranged above the upper washing item receptacle. In the starting position the lower washing item receptacle is arranged, in particular, below the upper washing item receptacle. In the end position, the lower washing item receptacle is preferably arranged at the same height or slightly below the upper washing item receptacle. The guide contour is groove-shaped and may also be denoted as a guide groove. The lifting lever comprises, in particular, a plate-shaped base portion, the guide contour being provided thereon.

According to one embodiment, the guide contour is designed to guide the washing item receptacle when said washing item receptacle is raised from the starting position to the end position and when said washing item receptacle is lowered from the end position to the starting position, such that a spacing between the rinsing container and the washing item receptacle is uniform.

It is to be understood by the spacing being uniform that, when the washing item receptacle is raised and when said washing item receptacle is lowered, the spacing is only altered within a predetermined tolerance range. For example, the predetermined tolerance range is +/−20 mm, further preferably +/−10 mm, further preferably +/−5 mm. The spacing is defined, in particular, as a spacing between a rear wall of the washing item receptacle and a front edge of a loading opening of the rinsing container. In particular, the washing item receptacle is guided by means of the guide contour such that said washing item receptacle, in particular, performs an approximately linear movement counter to a direction of gravity when said washing item receptacle is raised from the starting position to the end position and vice versa and/or when lowered in the direction of gravity. In particular, it is to be understood by the spacing being uniform that when the washing item receptacle is raised and lowered the washing item receptacle does not follow an arcuate movement of a pivot point of the lifting lever mounted on the guide mechanism.

According to a further embodiment, the guide contour defines a maximum withdrawal path of the washing item receptacle when said washing item receptacle is moved from the starting state to the end state.

As a result, the washing item receptacle is reliably prevented from being withdrawn too far out of the rinsing container. The maximum withdrawal path, in particular, is defined as a spacing between the front edge of the loading opening and a front wall of the washing item receptacle. In particular, when the maximum withdrawal path is reached, a guide pin of the washing item receptacle bears against an apex of the guide contour.

According to a further embodiment, the guide contour has a first guide portion and a second guide portion connected to the first guide portion, wherein the second guide portion is inclined at an angle of inclination relative to the first guide portion.

The first guide portion and the second guide portion intersect at the aforementioned apex. The first guide portion and the second guide portion form a geometry which corresponds to the number one. The angle of inclination is for example 40 to 70°, further preferably 45 to 65°, further preferably 50 to 60°, further preferably 55°. However, the angle of inclination may be of any size.

According to a further embodiment, the first guide portion is straight and the second guide portion is straight or curved.

The second guide portion may, in particular, be curved in an arcuate manner, preferably in a circular arc-shaped manner. The second guide portion, however, may have any geometry. By means of the geometry of the second guide portion the movement of the washing item receptacle may be controlled when said washing item receptacle is raised from the starting position to the end position and vice versa. As a result, a lifting movement of the washing item receptacle which is as linear as possible may be achieved.

According to a further embodiment, the first guide portion in the starting position is arranged parallel to the guide mechanism and in the end position is arranged perpendicular to the guide mechanism.

In other words, the first guide portion is rotated in each case by 90° when the washing item receptacle is moved from the starting position to the end position and vice versa. An angle of 90° is understood in the present case as an angle of 90°+/−10°, further preferably 90°+/−5°, further preferably 90°+/−1°, further preferably exactly 90°.

According to a further embodiment, in the starting position and in the end position the second guide portion is arranged so as to be inclined relative to the guide mechanism, wherein in the starting position the second guide portion is inclined by 90° relative to its orientation in the end position.

In other words, the second guide portion is rotated in each case by 90° when the washing item receptacle is moved from the starting position to the end position and vice versa. In particular, in the starting position the second guide portion is inclined by the previously mentioned angle of inclination relative to the guide mechanism.

According to a further embodiment, the guide contour has a first guide portion, a second guide portion connected to the first guide portion, a third guide portion connected to the second guide portion and a fourth guide portion connected to the third guide portion. The four guide portions preferably form a U-shaped or approximately U-shaped guide contour. The four guide portions preferably have rectilinear or approximately rectilinear paths.

The first guide portion serves for collecting and positioning the washing item receptacle, whereas the second guide portion and the third guide portion serve for arresting a movement of the guide mechanisms when the washing item receptacle is moved from the starting position to the end position and vice versa. Finally, the fourth guide portion serves for potential system maintenance since in this fourth guide portion the washing item receptacle may be removed from the guide contour.

The first guide portion and/or the guide mechanisms may be set at an angle of 0° to +2° relative to the horizontal. This setting permits a greater lifting height in the front region and a visually attractive design in the raised state when fully loaded.

According to a further embodiment, the washing item receptacle has a guide pin which is guided in the guide contour when the washing item receptacle is raised from the starting position to the end position and when the washing item receptacle is lowered from the end position to the starting position. The guide pin is T-shaped or mushroom-shaped in cross section, in particular.

Preferably, the washing item receptacle has two such guide pins which are provided on opposing sides of the washing item receptacle. In each case the guide pin forms with the guide contour assigned thereto a sliding guide of the lifting mechanism. Preferably, in each case such a sliding guide is provided on either side of the washing item receptacle.

In particular, the guide pin is T-shaped in cross section. The guide pin has a bar-shaped shank and a disk-shaped head arranged on the shank on the front face thereof. In this case, a diameter of the head is greater than a diameter of the shank. The guide contour is configured so as to correspond to the geometry of the guide pin and encompasses said guide pin positively. As a result, the guide pin may be reliably prevented from slipping out of the guide contour when the washing item receptacle is raised and lowered. A positive connection is formed by the interlocking or rear engagement of at least two connection partners, in this case the guide pin and the guide contour.

According to a further embodiment, in the starting state the guide pin is out of engagement with the guide contour and/or when the washing item receptacle is moved from the starting state to the end state the guide pin is brought into positive engagement with the guide contour.

In the starting state, therefore, the guide pin is not located in the guide contour.

When the washing item receptacle is moved from the starting state to the end state the guide pin is automatically engaged in the guide contour and when the washing item receptacle is moved from the end state to the starting state the guide pin is again brought out of engagement with the guide contour.

According to a further embodiment, the guide contour has a lead-in chamfer for inserting the guide pin into the guide contour when the washing item receptacle is moved from the starting state to the end state.

The lead-in chamfer, in particular, is of funnel-shaped configuration and has two side walls which oppose one another and which are inclined relative to one another. By means of the guide contour it is ensured that when the washing item receptacle is moved from the starting state to the end state the guide pin is positively engaged in the guide contour.

According to a further embodiment, the guide contour has a latching geometry, in particular a latching lug, between the first guide portion and the second guide portion.

The latching geometry, in particular the latching lug, serves for arresting a movement of the guide mechanisms when the washing item receptacle is moved from the starting position to the end position and vice versa.

According to a further embodiment, the guide pin cooperates with a spring-loaded latching bolt which is brought into engagement outside the guide contour, or a spring element which is supported against the guide contour acts on the guide pin.

The spring-loaded latching bolt, which is brought into engagement outside the guide contour, is latched in the front end position of the washing item receptacle outwardly beyond the guide contour and serves at the same time for arresting a movement of the guide mechanisms when the washing item receptacle is moved from the starting position to the end position and vice versa. Moreover, said latching bolt is preferably movably arranged on, or approximately on, the central line of the first guide contour.

The spring element which acts on the guide pin and which is supported against the guide contour ensures, amongst other things, that the guide pin is able to be guided securely and effectively via the latching geometry, in particular the latching lug, when arresting a movement of the guide mechanisms when the washing item receptacle is moved from the starting position to the end position and vice versa.

According to a further embodiment, the lifting mechanism comprises at least one first lifting lever which has the guide contour and at least one second lifting lever which is arranged spaced apart from the at least one first lifting lever and which is pivotably connected to the rinsing container and the guide mechanism.

In other words, the two lifting levers are pivotably connected to the guide mechanism and pivotably connected to the rinsing container. In particular, the lifting levers are pivotably connected to a side wall of the rinsing container. The guide mechanism is, in particular, a so-called telescopic rail. The guide mechanism has a first guide rail, a second guide rail which is movable in a linear manner relative to the first guide rail, and a third guide rail arranged between the first guide rail and the second guide rail. The washing item receptacle in this case is fastened to the second guide rail and the lifting levers are pivotably fastened to the first guide rail. To this end, the lifting levers have corresponding pivot points.

The lifting mechanism preferably has two first lifting levers and two second lifting levers which are arranged in pairs on either side of the washing item receptacle.

Accordingly, two guide mechanisms which are arranged on either side of the washing item receptacle are also provided. The guide mechanisms may be part of the lifting mechanism.

According to a further embodiment, the household dishwasher preferably comprises two guide mechanisms, wherein in each case a first lifting lever and a second lifting lever are pivotably connected to the respective guide mechanism.

In particular, a first guide mechanism which is assigned to a first side wall of the rinsing container is provided and a second guide mechanism which is assigned to a second side wall of the rinsing container is provided. The guide mechanisms are, in particular, of the same construction and arranged mirror-symmetrically.

Further possible implementations of the household dishwasher also comprise not explicitly cited combinations of features or embodiments which are described above or below relative to the exemplary embodiments. In this case, the person skilled in the art will also add individual features as improvements or additions to the respective basic form of the household dishwasher.

BRIEF DESCRIPTION OF THE DRAWINGS

Further advantageous embodiments and features of the household dishwasher form the subject-matter of the subclaims and the exemplary embodiments of the household dishwasher described below. The household dishwasher is described hereinafter in more detail by means of preferred embodiments, with reference to the accompanying figures, in which:

DETAILED DESCRIPTION OF EXEMPLARY EMBODIMENTS OF THE PRESENT INVENTION

Figure 1:
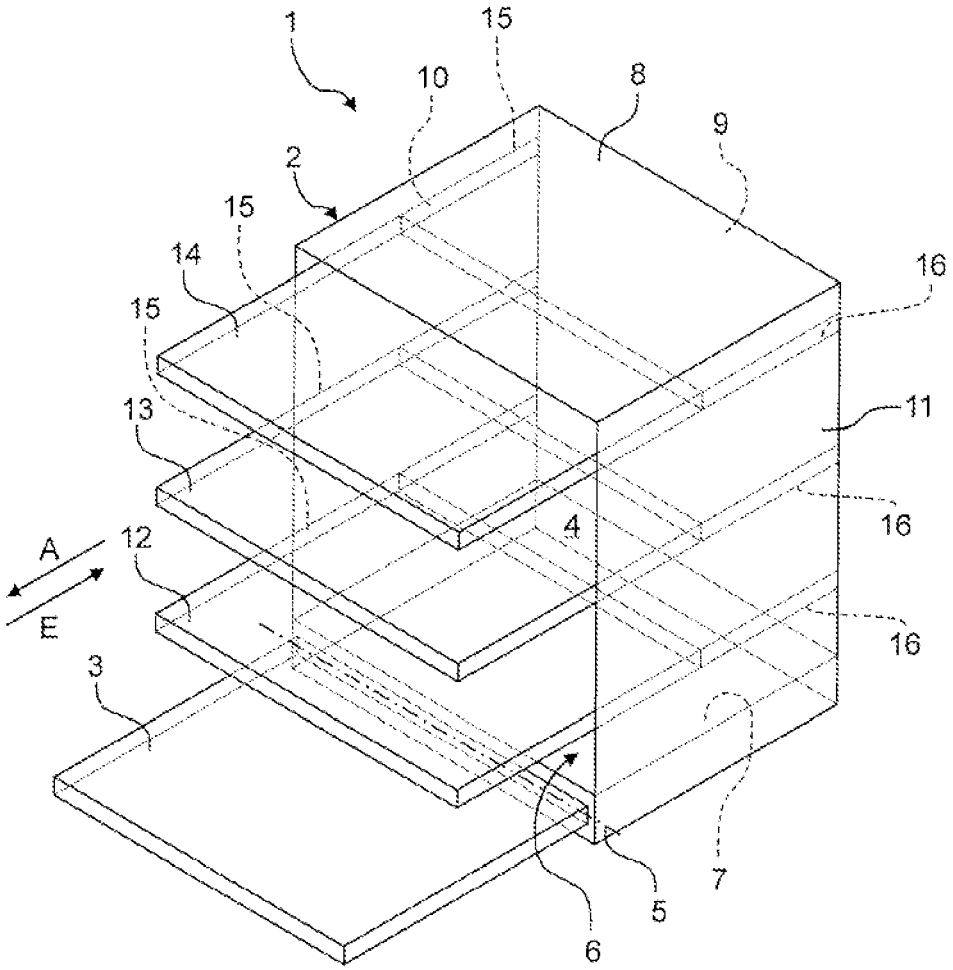
FIG. 1 shows a schematic perspective view of an embodiment of a household dishwasher.

Elements which are the same or functionally the same have been provided with the same reference numerals in the figures unless indicated otherwise.

FIG. 1 shows a schematic perspective view of an embodiment of a household dishwasher 1. The household dishwasher 1 comprises a rinsing container 2 which is able to be closed by a door 3, in particular in a watertight manner. To this end, a sealing device may be provided between the door 3 and the rinsing container 2. The rinsing container 2 is preferably cuboidal. The rinsing container 2 may be arranged in a housing of the household dishwasher 1. The rinsing container 2 and the door 3 may form a rinsing chamber 4 for washing items to be washed.

The door 3 in FIG. 1 is shown in its open position. The door 3 may be closed or opened by pivoting about a pivot axis 5 provided at a lower end of the door 3. A loading opening 6 of the rinsing container 2 may be closed or opened by means of the door 3. The rinsing container 2 has a bottom 7, a ceiling 8 arranged opposite the bottom 7, a rear wall 9 arranged opposite the closed door 3 and two opposingly arranged side walls 10, 11. The bottom 7, the ceiling 8, the rear wall 9 and the side walls 10, 11 may be made, for example, from a stainless steel sheet. Alternatively, for example, the bottom 7 may be made from a plastics material.

The household dishwashing machine 1 further comprises at least one washing item receptacle 12 to 14. Preferably, a plurality of, for example three, washing item receptacles 12 to 14 may be provided, wherein the washing item receptacle 12 may be a lower washing item receptacle or a lower basket, the washing item receptacle 13 may be an upper washing item receptacle or an upper basket, and the washing item receptacle 14 may be a cutlery drawer. As FIG. 1 also shows, the washing item receptacles 12 to 14 are arranged on top of one another in the rinsing container 2. Each washing item receptacle 12 to 14 is optionally movable into or out of the rinsing container 2. In particular, each washing item receptacle 12 to 14 is able to be inserted in an insertion direction E (arrow) into the rinsing container 2 and withdrawn counter to the insertion direction E (arrow) in a withdrawal direction A (arrow) out of the rinsing container 2.

The washing item receptacle 12 is also able to be raised by a lifting mechanism, to be described in more detail below, from a starting position to an end position in which it is preferably arranged in front of the washing item receptacle 13 and approximately at the same height thereof. Each washing item receptacle 12 to 14 is assigned a first guide mechanism 15 and a second guide mechanism 16. The guide mechanisms 15, 16 are arranged in each case on either side of the washing item receptacle 12 to 14 assigned thereto. The guide mechanisms 15, 16 may be configured as guide rails, in particular as so-called telescopic rails.

Figure 2:
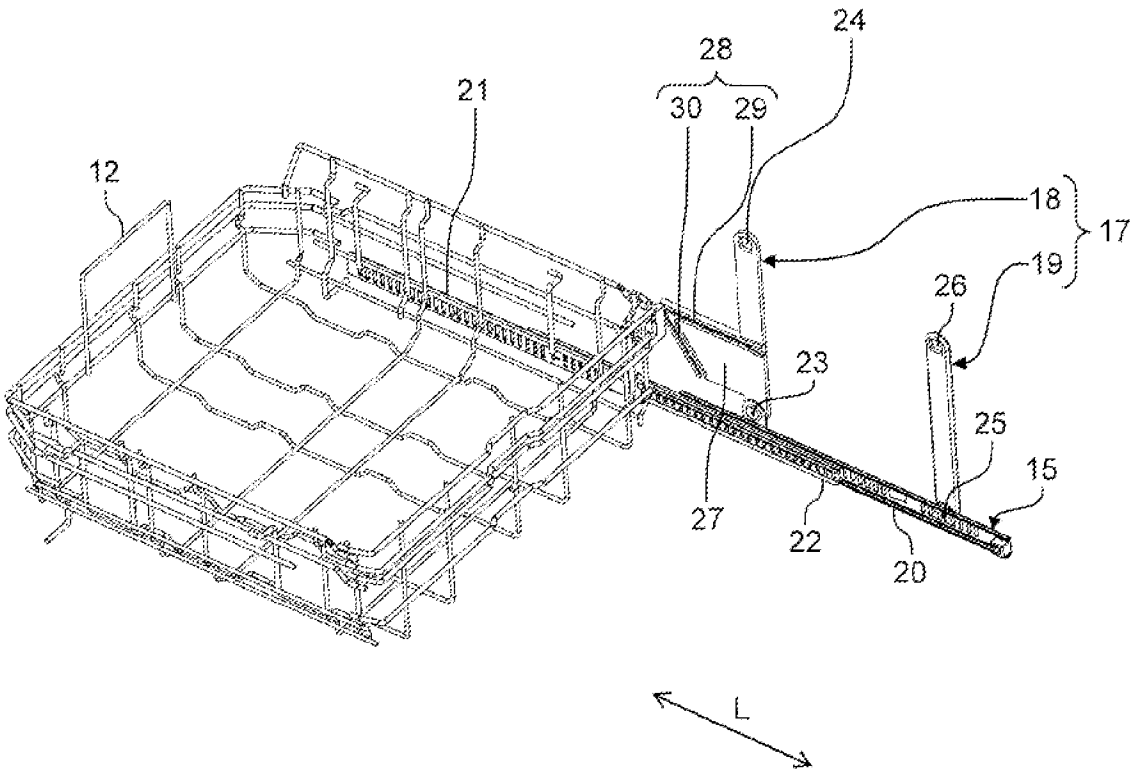
FIG. 2 shows a schematic perspective view of a lifting mechanism and a washing item receptacle for the household dishwasher according to FIG. 1.
Figure 3:
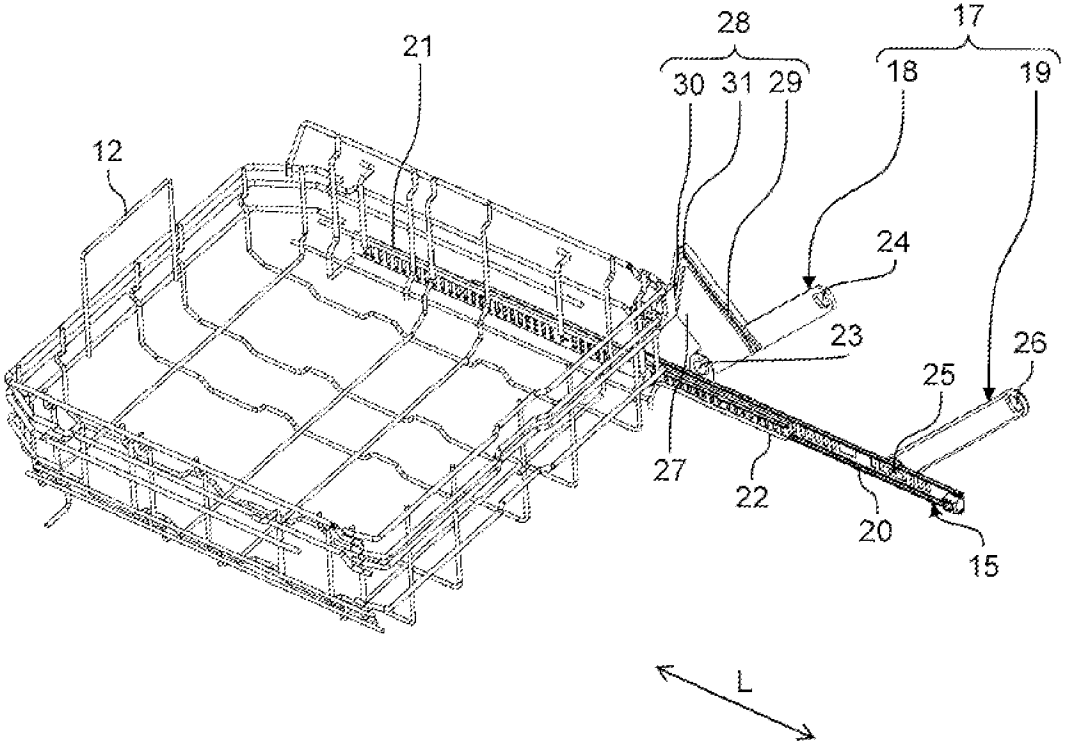
FIG. 3 shows a further schematic perspective view of the lifting mechanism and the washing item receptacle according to FIG. 2.

FIGS. 2 and 3 show in each case schematic perspective views of the washing item receptacle 12 with a lifting mechanism 17 for raising and lowering the washing item receptacle 12. The lifting mechanism 17 comprises two first pivot levers or lifting levers 18, in each case only one thereof being shown in FIGS. 2 and 3, and two second pivot levers or lifting levers 19, in each case only one thereof also being shown in FIGS. 2 and 3. The lifting levers 18, 19 are bar-shaped. Preferably, in each case a first lifting lever 18 and a second lifting lever 19 are arranged on either side of the washing item receptacle 12. As already mentioned above, a guide mechanism 15, 16 is also arranged on either side of the washing item receptacle 12, wherein only the first guide mechanism 15 is shown in FIGS. 2 and 3. The lifting mechanism 17 may thus also have the guide mechanisms 15, 16 in addition to the lifting levers 18, 19. The guide mechanisms 15, 16 are constructed identically. However, only one guide mechanism 15 and a pair of lifting levers 18, 19 are described hereinafter.

The guide mechanism 15, as already mentioned above, is configured as a telescopic rail. The guide mechanism 15 comprises a first guide rail 20, the lifting levers 18, 19 being able to be pivotably mounted thereon. The first guide rail 20 may also be denoted as the inner rail. The guide mechanism 15 further comprises a second guide rail 21 which is movable relative to the first guide rail 20. The second guide rail 21 is movable in a longitudinal direction L (double arrow) of the guide mechanism 15 in a linear manner relative to the first guide rail 20. The second guide rail 21 may also be denoted as the outer rail. In order to permit the linear mobility of the second guide rail 21 relative to the first guide rail 20 in the longitudinal direction L (double arrow) a third guide rail 22 is provided between the first guide rail 20 and the second guide rail 21. The third guide rail 22 may also be denoted as the connecting rail. The third guide rail 22 is movable in a linear manner both relative to the first guide rail 20 and also relative to the second guide rail 21 in the longitudinal direction L (double arrow).

The washing item receptacle 12 is fastened to the second guide rail 21. For example, the washing item receptacle 12 may be clipped into the second guide rail 21 or placed thereon. In particular, a frame, not shown, may be provided to this end, the washing item receptacle 12 being able to be inserted or clipped therein and said frame being connected to the second guide rail 21.

As mentioned above, the first lifting lever 18 and the second lifting lever 19 are pivotably mounted on the first guide rail 20. In this case, the lifting levers 18, 19 are positioned in the longitudinal direction L (double arrow) spaced apart from one another. The first lifting lever 18 comprises a first pivot point 23 which is rotatably mounted on the first guide rail 20. The first lifting lever 18 further comprises a second pivot point 24 which is pivotably mounted on the rinsing container 2 and, in particular, pivotably mounted on one of the side walls 10, 11, preferably on the first side wall 10. Similarly, the second lifting lever 19 has a first pivot point 25 which is pivotably mounted on the first guide rail 20 and a second pivot point 26 which is pivotably mounted on the rinsing container 2 and, in particular, on one of the side walls 10, 11, preferably on the first side wall 10.

The first lifting lever 18 further comprises a plate-shaped base portion 27 extending laterally out of said first lifting lever. The base portion 27, in particular, is configured integrally from the same material as the first lifting lever 18. A guide contour 28 or guide groove is provided on the base portion 27. A guide pin which is provided on the washing item receptacle 12, and not shown in FIGS. 2 and 3, is guided in the guide contour 28. The guide contour 28 comprises a first guide portion 29 and a second guide portion 30 connected to the first guide portion 29. The guide portions 29, 20 intersect at an apex 31. The first guide portion 29 is straight and the second guide portion 30 may also be configured to be straight or curved, in particular curved in a circular arc-shaped manner. The guide contour thus forms the shape of the number one.

Figure 4:
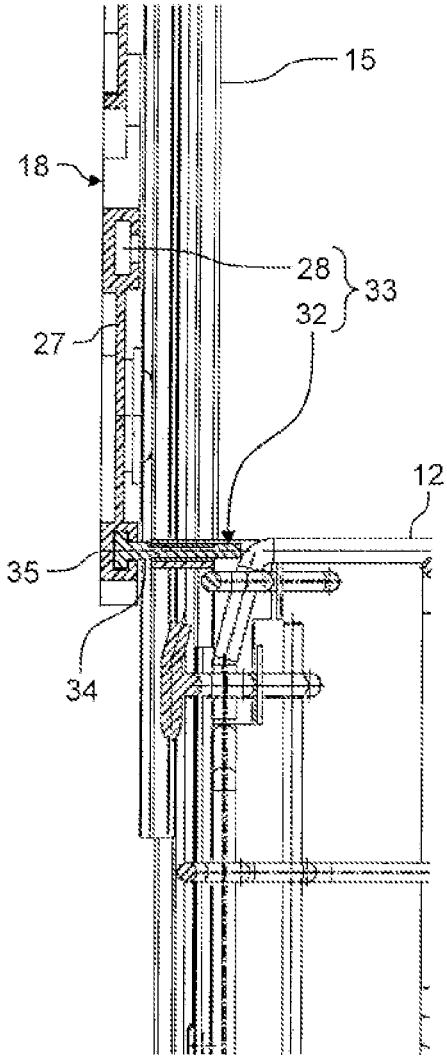
FIG. 4 shows a schematic partial sectional view of the lifting mechanism and the washing item receptacle according to FIG. 2.

FIG. 4 shows a schematic sectional view through the first lifting lever 18 and the washing item receptacle 12. As FIG. 4 shows, a guide pin 32 is provided on the washing item receptacle 12. In particular, in each case such a guide pin 32 is provided on either side of the washing item receptacle 12. The guide pin 32 may be a wire pin. The guide pin 32 is received in the guide contour 28 and forms therewith a sliding guide 33 of the lifting mechanism 17. The guide pin 32 may have a bar-shaped shank 34 and a disk-shaped head 35. A diameter of the head 35 in this case is greater than a diameter of the shank 34. Thus the guide pin 32 is T-shaped or mushroom-shaped in cross section. The guide contour 28 is configured so as to correspond to the geometry of the guide pin 32 so that the guide contour 28 positively encompasses the guide pin 32. A positive connection is produced by the interlocking or rear engagement of at least two connection partners, in this case the guide contour 28 and the head 35 of the guide pin 32. As a result, the guide pin 32 is reliably prevented from slipping out of the guide contour 28.

FIGS. 5 to 8 show different sectional views of the household dishwasher 1 according to FIG. 1. With reference to FIGS. 5 to 8 the function of the household dishwasher 1 and/or the lifting mechanism 17 is described hereinafter.

As FIGS. 5 to 8 show the rinsing container 2 is arranged in a housing 36 of the household dishwasher 1. A bottom support 37 on which the rinsing container 2 is supported is provided below the rinsing container 2. The bottom support 37 is preferably a plastics component. In particular, the bottom support 37 may be a plastics injection-molded component. The bottom support 37 may be of box-shaped configuration and receive electronic components, such as for example a lye pump, a circulating pump, a control device or the like of the household dishwasher 1.

Figure 5:
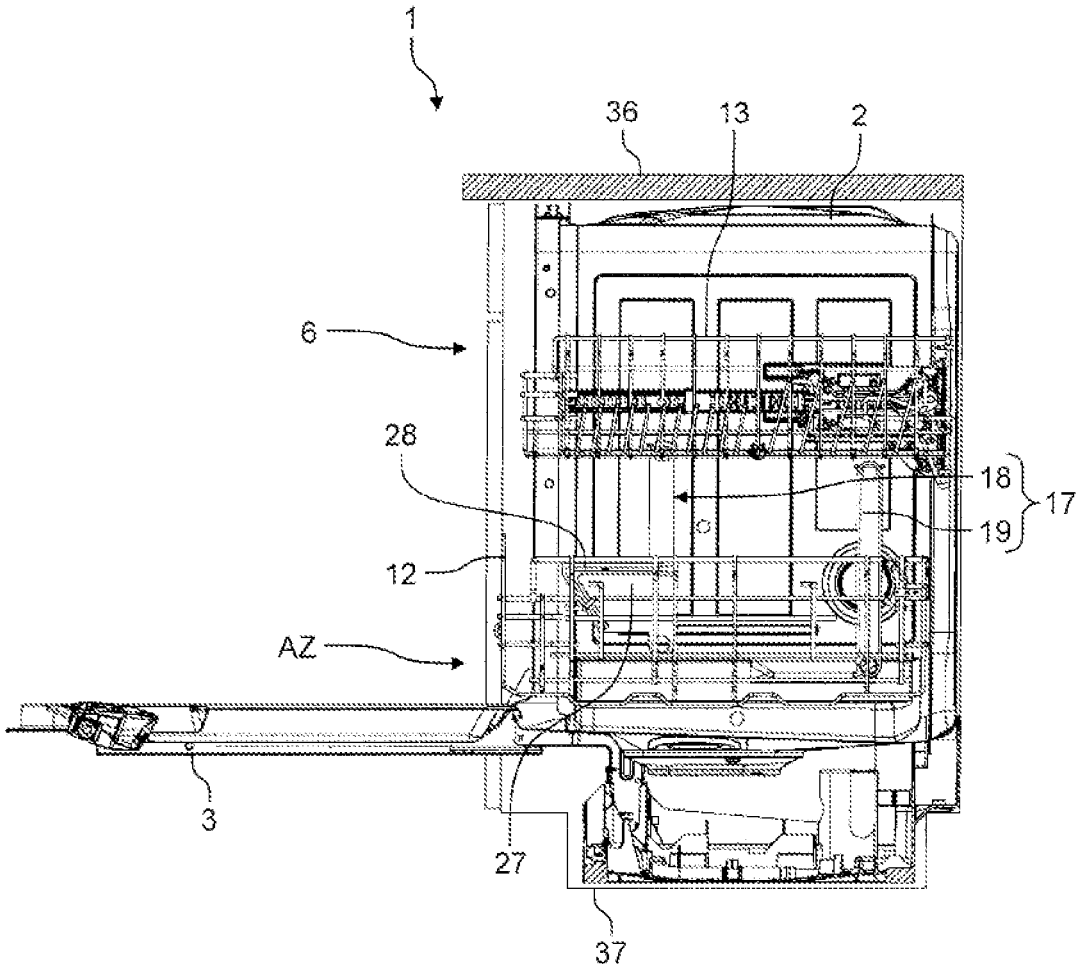
FIG. 5 shows a schematic sectional view of the household dishwasher according to FIG. 1.
Figure 6:
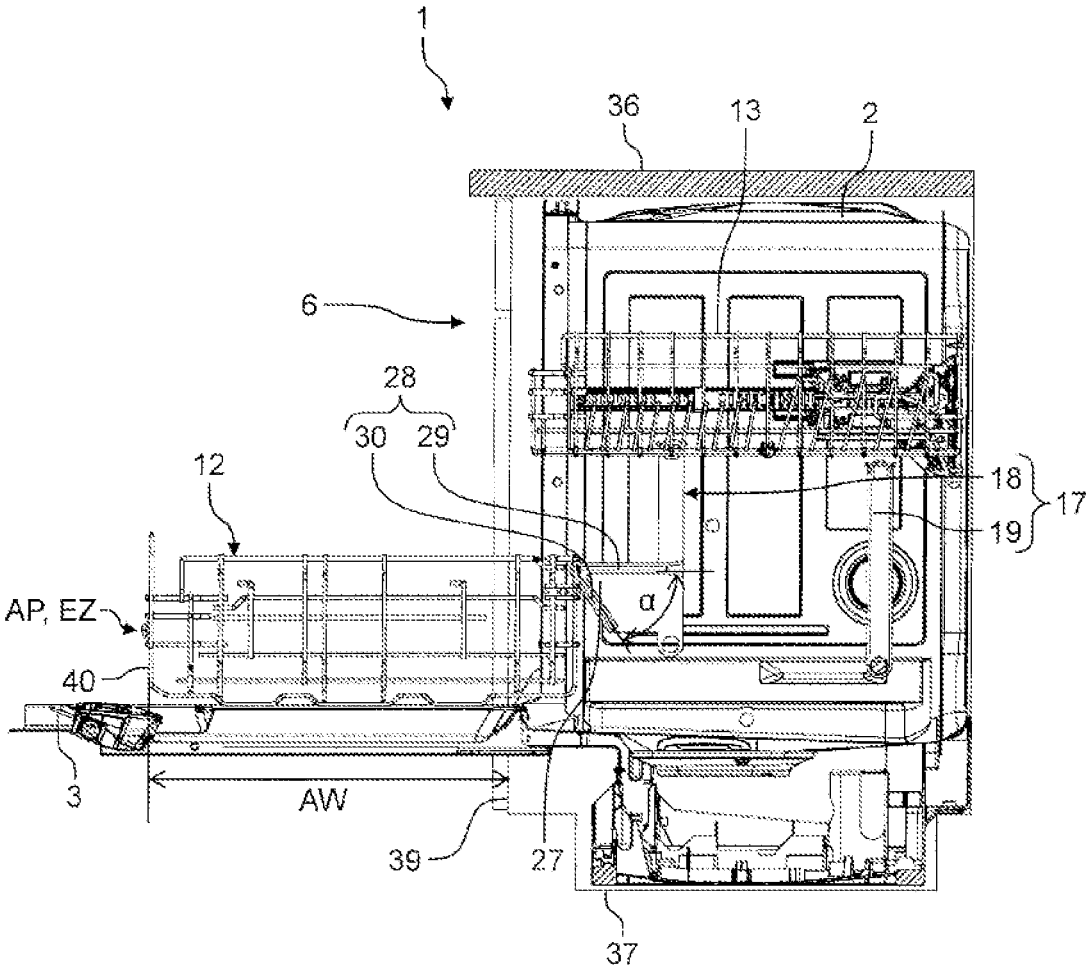
FIG. 6 shows a further schematic sectional view of the household dishwasher according to FIG. 1.

In FIGS. 5 to 8 the guide mechanisms 15, 16, along which the washing item receptacle 12 is guided, are not shown for a simplified view. As FIG. 6 shows the second guide portion 30 is inclined at an angle of inclination $\alpha$ relative to the first guide portion 29. The angle of inclination $\alpha$ may for example be 40 to 70°, preferably 45 to 65°, further preferably 50 to 60°, further preferably 55°. The guide contour 28 also has a lead-in chamfer 38 (FIG. 7) for inserting the guide pin 32 into the guide contour 28.

By means of the guide mechanisms 15, 16, not shown, the washing item receptacle 12 is movable from a starting state AZ (FIG. 5) arranged inside the rinsing container 2 to an end state EZ (FIG. 6) arranged outside the rinsing container 2 and vice versa. In other words, the washing item receptacle 12 is movable in the withdrawal direction A (arrow) out of the rinsing container 2 and is movable in the insertion direction E (arrow) into the rinsing container 2.

Figure 8:
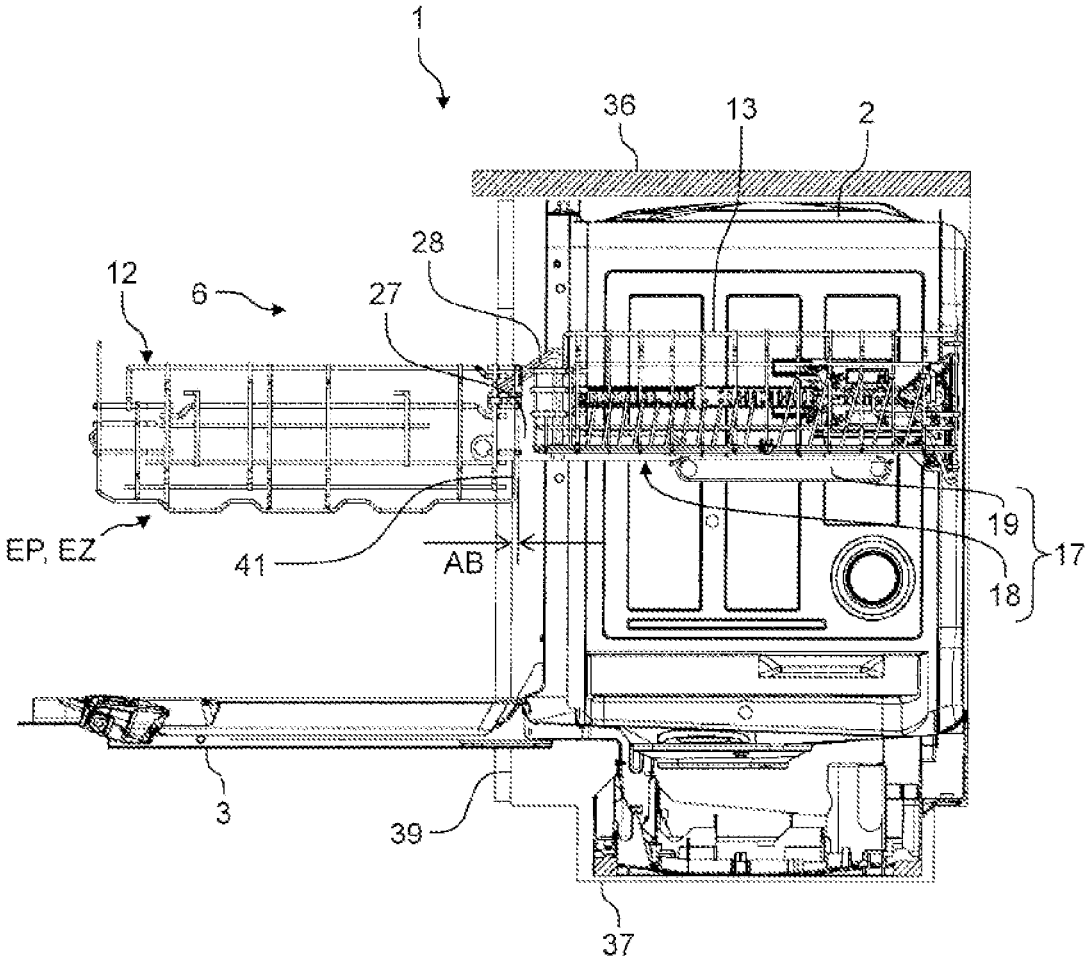
FIG. 8 shows a further schematic sectional view of the household dishwasher according to FIG. 1.

By means of the lifting mechanism 17, the washing item receptacle 12 may be moved from a starting position AP shown in FIG. 6 to an end position EP shown in FIG. 8 and vice versa, when the washing item receptacle is in the end state EZ, i.e. when the washing item receptacle 12 is arranged entirely outside the rinsing container 2. In other words, the washing item receptacle 12 may be raised by means of the lifting mechanism 17 from the starting position AP to the end position EP and lowered from the end position EP to the starting position AP. In the end position EP the washing item receptacle 12 is preferably arranged approximately at the same height as the washing item receptacle 13. In the starting position AP the washing item receptacle 12 is arranged, in particular, below the washing item receptacle 13.

The guide contour 28 is thus designed to arrest the washing item receptacle 12 in the end position EP when the washing item receptacle is raised from the starting position AP to the end position EP and in the end state EZ when said washing item receptacle is lowered from the end position EP to the starting position AP. In other words, only in the starting position AP is the washing item receptacle 12 not arrested and thus movable from the starting state AZ to the end state EZ and vice versa. In other words, the washing item receptacle 12 may only be inserted into the rinsing container 2 and withdrawn therefrom when the washing item receptacle 12 is in the starting position AP. As a result, collisions of the washing item receptacle 12 with the washing item receptacle 13 may be reliably prevented.

Figure 7:
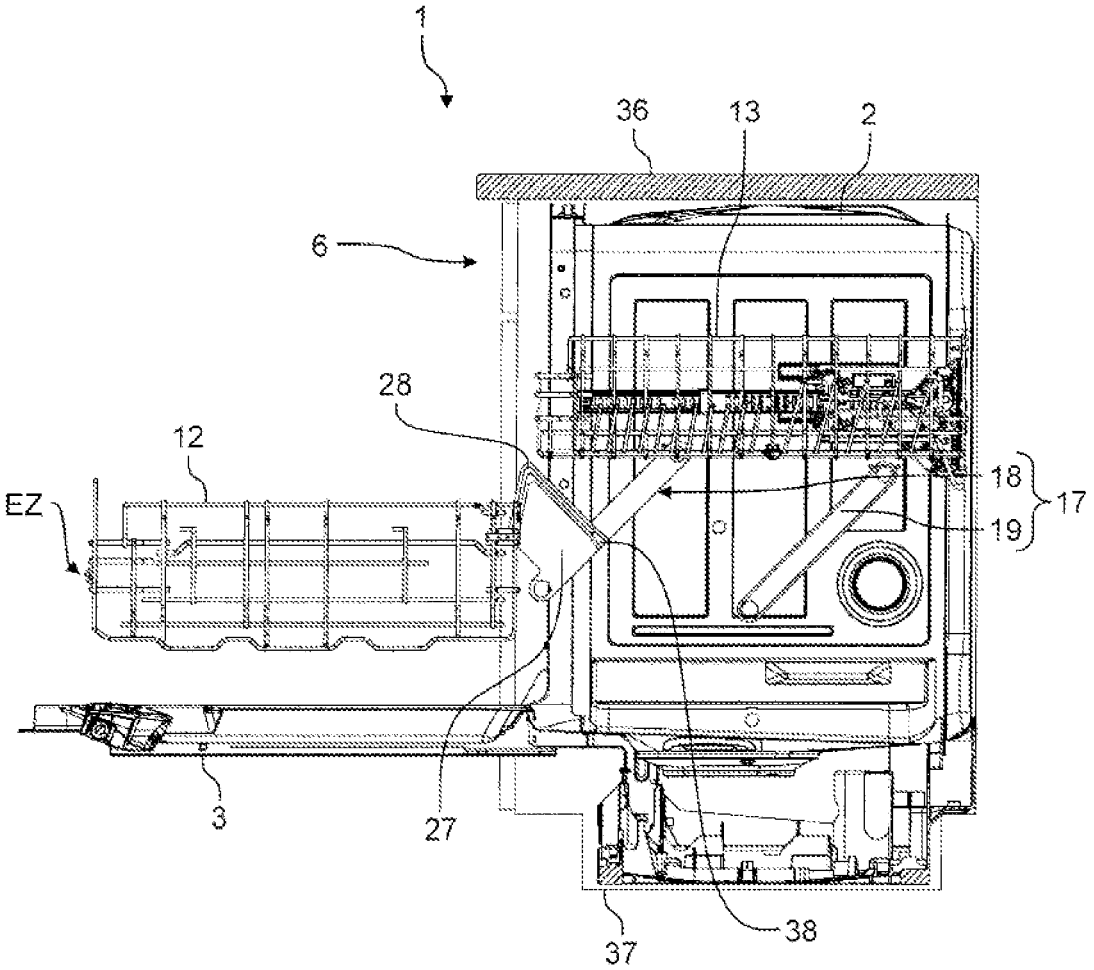
FIG. 7 shows a further schematic sectional view of the household dishwasher according to FIG. 1.

In particular, the guide contour 28 defines a maximum withdrawal path AW (FIG. 6) of the washing item receptacle 12 when said washing item receptacle is moved from the starting state AZ to the end state EZ. If the maximum withdrawal path AW is reached, the guide pin 32 bears against the apex 31 of the guide contour 28. The maximum withdrawal path AW in this case is defined as a spacing of a front edge 39 of the loading opening 6 from a front wall 40 of the washing item receptacle 12. Between the starting position AP and the end position EP the washing item receptacle 12, as FIG. 7 shows, is moved into any number of intermediate positions.

As the guide contour 28 has the second guide portion 30 which is arranged at the angle of inclination $\alpha$ relative to the first guide portion 29, the guide contour 28 is designed to guide the washing item receptacle 12 when said washing item receptacle is raised from the starting position AP to the end position EP and when said washing item receptacle is lowered from the end position EP to the starting position AP such that a spacing AB (FIG. 8) between the rinsing container 2 and the washing item receptacle 12 is approximately uniform. In particular, the spacing AB is defined as a spacing between the front edge 39 of the rinsing container and a rear wall 41 of the washing item receptacle 12.

It is to be understood by the spacing AB being uniform that when the washing item receptacle 12 is raised from the starting position AP to the end position EP the spacing AB moves away from or approaches the front edge 39 only in a predetermined tolerance range, for example in a range of +/−10 mm. In particular, it is to be understood by the spacing AB between the rinsing container 2 and the washing item receptacle 12 being uniform that the washing item receptacle 12 does not follow an arcuate movement of the first pivot point 23 of the first lifting lever 18, when raised from the starting position AP to the end position EP and vice versa. As a result, the washing item receptacle 12 may be raised and lowered in a substantially linear manner.

As FIG. 5 shows, the first guide portion 29 of the guide contour 28 in the starting position AP is arranged parallel to the guide mechanism 15 and in the end position EP is arranged perpendicular to the guide mechanism 15. Moreover, in the starting position AP and in the end position EP the second guide portion 30 is arranged so as to be inclined relative to the guide mechanism 15. In this case, in the starting position AP the second guide portion 30 is inclined by 90° relative to its orientation in the end position EP. In other words, the guide contour 28 rotates in each case by 90° when the washing item receptacle 12 is moved from the starting position AP to the end position EP and vice versa.

When the washing item receptacle 12 is raised from the starting position AP to the end position EP and when the washing item receptacle 12 is lowered from the end position EP to the starting position AP the guide pin 32 is always guided in the guide contour 28. In the starting state AZ the guide pin 32, however, is out of engagement with the guide contour 28. When the washing item receptacle 12 is moved from the starting state AZ to the end state EZ, the guide pin 32 is brought into positive engagement with the guide contour 28. To this end, the aforementioned lead-in chamfer 38 is provided on the guide contour 28.

Figure 9:
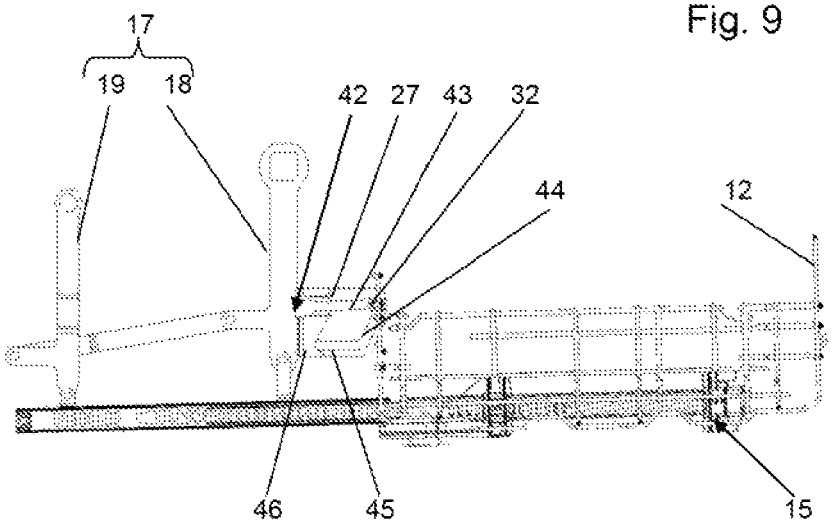
FIG. 9 shows a further schematic view of a lifting mechanism and a washing item receptacle for a household dishwasher according to FIG. 1.

FIG. 9 shows a schematic view of a further lifting mechanism 17 and a washing item receptacle 12 for a household dishwasher as is shown and described, for example, in FIG. 1.

With regard to the construction and the function of the lifting mechanism 17 and the guide mechanisms 15, 16, reference is made to FIGS. 2 to 8 together with the description of the figures associated therewith; the disclosure thereof forming the subject-matter of the description of FIG. 9.

The first lifting lever 18 of the lifting mechanism 17 comprises a plate-shaped base portion 27 extending laterally out of said lifting lever. The base portion 27 is, in particular, configured integrally from the same material as the first lifting lever 18. A guide contour 42 or guide groove is provided on the base portion 27. A guide pin 32 provided on the washing item receptacle 12 is guided in the guide contour 42. The guide contour 42 has a first guide portion 43, a second guide portion 44 connected to the first guide portion 43, a third guide portion 45 connected to the second guide portion 44 and a fourth guide portion 46 connected to the third guide portion 45. The four guide portions 43 to 46 preferably form a U-shaped or approximately U-shaped guide contour 42.

Figure 10:
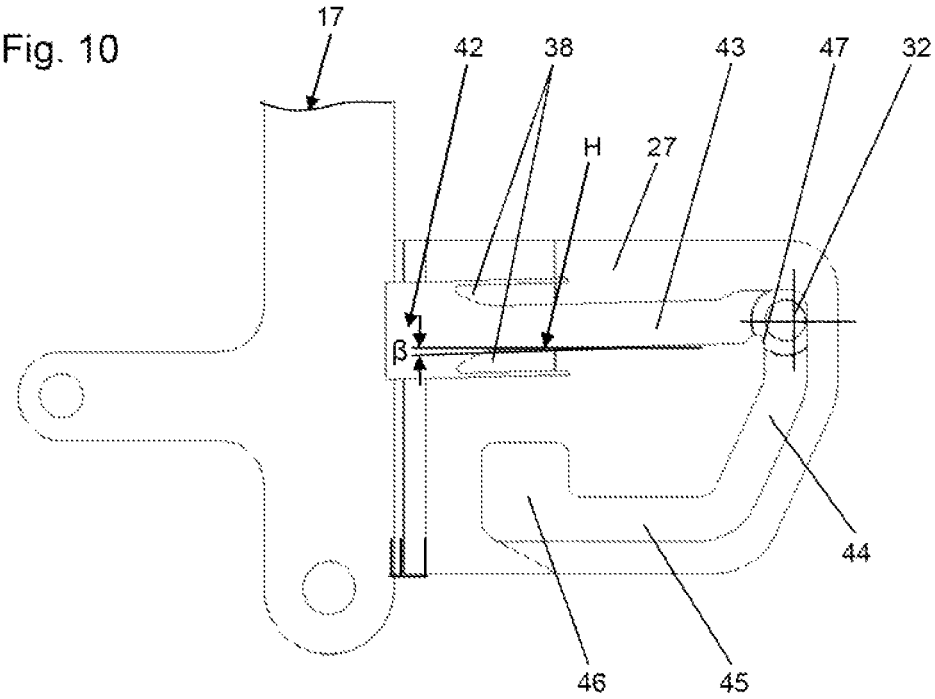
FIG. 10 shows a schematic partial view of the lifting mechanism according to FIG. 9.

FIG. 10 shows a schematic partial view of the lifting mechanism 17 according to FIG. 9.

The first guide portion 43 of the guide contour 42 serves for collecting and positioning the washing item receptacle, whereas the second guide portion 44 and the third guide portion 45 serve for arresting a movement of the guide mechanisms 15, 16 (FIGS. 2 to 8) when the washing item receptacle 12 (FIG. 9) is moved from the starting position AP (FIG. 9) to an end position (FIG. 8) and vice versa. Finally the fourth guide portion 46 of the guide contour 42 serves for potential system maintenance since in this fourth guide portion 46 the washing item receptacle 12 (FIG. 9) may be removed from the guide contour 42.

The first guide portion 43 and/or the guide mechanisms 15, 16 (FIGS. 2 to 8) may be set at an angle β of 0° to +2° relative to the horizontal H. This setting permits a greater lifting height in the front region and a visually attractive design in the raised state when fully loaded. Moreover, the guide contour 42 has a lead-in chamfer 38 for inserting the guide pin 32 into the guide contour 42.

Furthermore, the guide contour 42 has a latching geometry 47, in particular a latching lug, between the first guide portion 43 and the second guide portion 44. The latching geometry 47, in particular the latching lug, serves for the secure fixing of the washing item receptacle 12 (FIG. 9) relative to the guide mechanisms 15, 16 (FIGS. 2 to 8).

Figure 11:
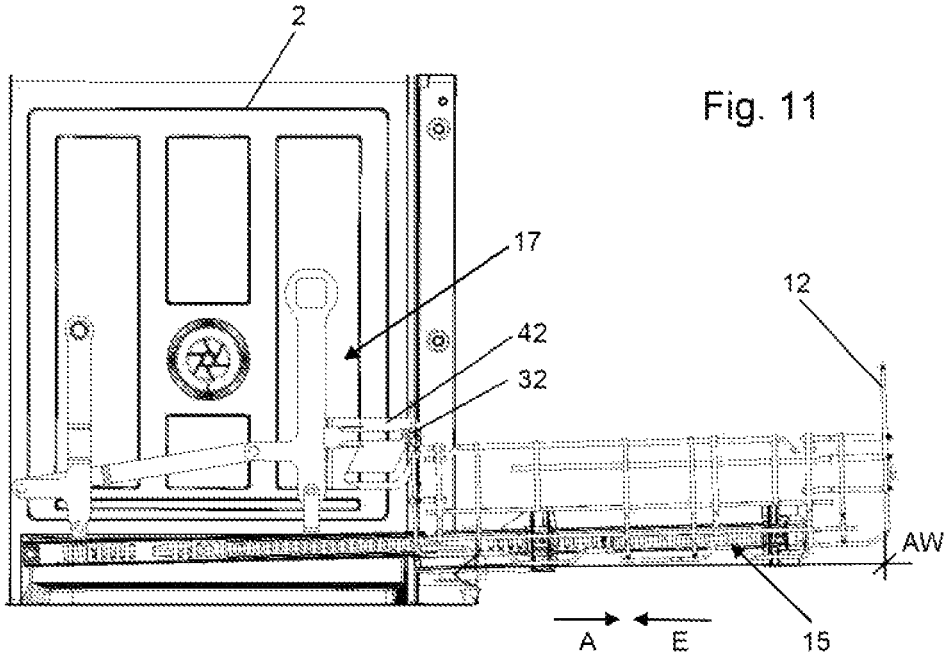
FIG. 11 shows a schematic sectional view of a household dishwasher with a lifting mechanism according to FIG. 9.
Figure 12:
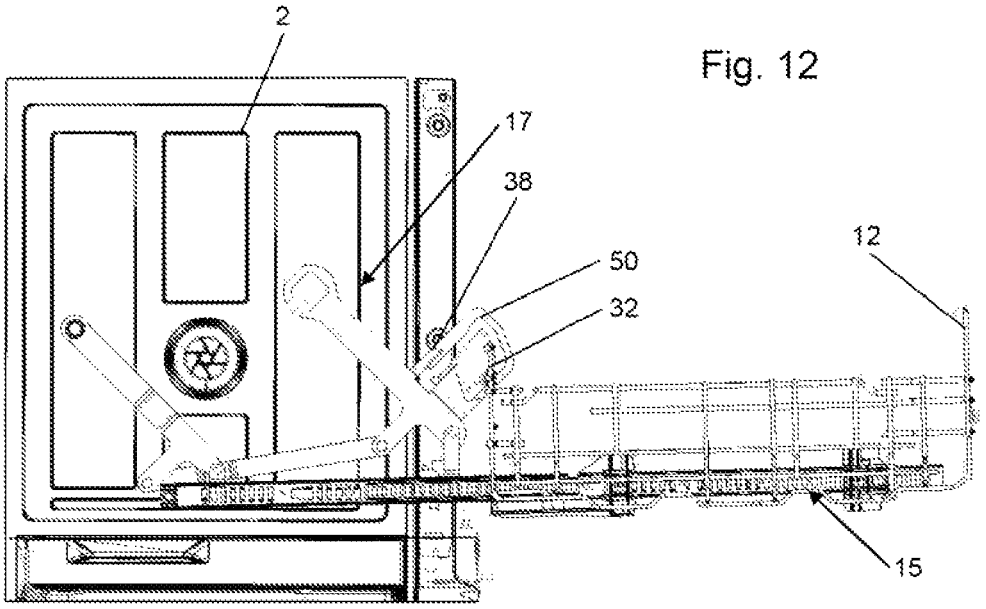
FIG. 12 shows a further schematic sectional view of a household dishwasher with a lifting mechanism according to FIG. 9.

FIGS. 11 and 12 show schematic sectional views of a household dishwasher 1 (FIG. 1) with a lifting mechanism 17 according to FIG. 9.

With regard to the lifting path and the function of the lifting mechanism 17 and the guide mechanisms 15, 16 reference is made to FIGS. 2 to 8; the disclosure thereof forming the subject-matter of the description of FIGS. 11 and 12.

By means of the guide mechanisms 15, 16 shown (FIGS. 2 to 8) the washing item receptacle 12 is movable from a starting state arranged inside the rinsing container 2 to an end state arranged outside the rinsing container 2 and vice versa. In other words, the washing item receptacle 12 is movable in the withdrawal direction A (arrow) out of the rinsing container 2 and is movable in the insertion direction E (arrow) into the rinsing container 2.

The guide contour 42 is designed to arrest the washing item receptacle 12 in the end position EP (FIG. 8) when said washing item receptacle is raised from the starting position AP (FIG. 11) to the end position EP (FIG. 8) and in the end state EZ (FIGS. 6 to 8) when said washing item receptacle is lowered from the end position EP (FIG. 8) to the starting position AP (FIG. 11). In other words, only in the starting position AP (FIG. 11) is the washing item receptacle 12 not arrested and thus movable from the starting state AZ (FIG. 5) to the end state EZ (FIGS. 6 to 8) and vice versa. In other words, the washing item receptacle 12 may only be inserted into the rinsing container 2 and withdrawn therefrom when the washing item receptacle 12 is in the starting position AP (FIG. 11). As a result, collisions of the washing item receptacle 12 with the washing item receptacle 13 (FIG. 5) may be reliably prevented.

In particular, the guide contour 42 defines a maximum withdrawal path AW (FIG. 6) of the washing item receptacle 12 when said washing item receptacle is moved from the starting state AZ (FIG. 5) to the end state EZ (FIGS. 6 to 8). If the maximum withdrawal path AW (FIG. 6) is reached, the guide pin 32 bears against the upper apex 50 (FIG. 12) of the guide contour 42. The maximum withdrawal path AW (FIG. 6) is in this case defined as a spacing of a front edge 39 of the loading opening 6 from a front wall 40 of the washing item receptacle 12. Between the starting position AP (FIG. 11) and the end position EP (FIG. 8) the washing item receptacle 12, as FIG. 12 shows, may be moved into any number of intermediate positions.

Figure 13:
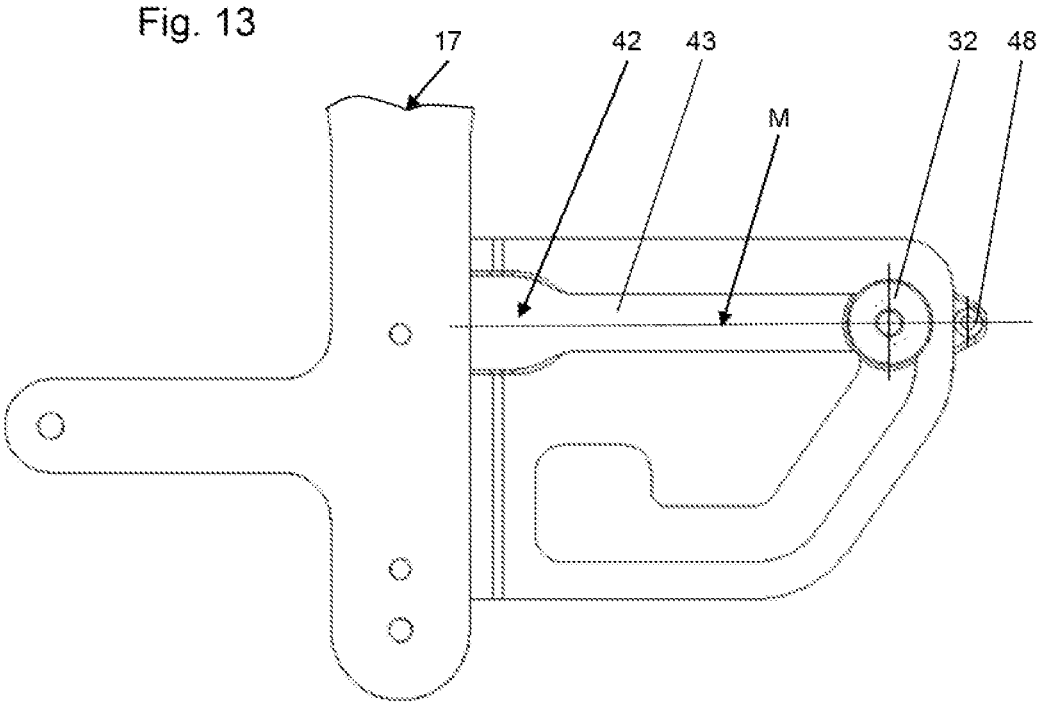
FIG. 13 shows a further schematic partial view of a lifting mechanism.

When the washing item receptacle 12 is raised from the starting position AP (FIG. 11) to the end position EP (FIG. 8) and when the washing item receptacle 12 is lowered from the end position EP (FIG. 8) to the starting position AP (FIG. 11) the guide pin 32 is always guided in the guide contour 42. In the starting state AZ (FIG. 5) the guide pin 32, however, is out of engagement with the guide contour 42. When the washing item receptacle 12 is moved from the starting state AZ (FIG. 5) to the end state EZ (FIGS. 6 to 8) the guide pin 32 is brought into positive engagement with the guide contour 28. To this end, the aforementioned lead-in chamfer 38 is provided on the guide contour 28. FIG. 13 shows a further schematic partial view of a lifting mechanism 17.

Since the principal construction of this further embodiment of the guide contour 42 of the lifting mechanism 17 corresponds to the embodiments of the guide contour 42 of the lifting mechanism 17 shown and described in FIGS. 9 and 10, the disclosure thereof hereby forms the subject-matter of the description of FIG. 13.

Instead of a latching geometry, in particular a latching lug, in the second embodiment shown in FIG. 13 a spring-loaded latching bolt 48, which acts with the guide pin 32, is used. The spring-loaded latching bolt 48 is brought into engagement outside the guide contour 42, in other words it is latched in the front end position of the washing item receptacle 12 (FIG. 9) outwardly beyond the guide contour 42 and at the same time fixes the washing item receptacle 12 (FIG. 9) relative to the guide mechanisms 15, 16 (FIGS. 2 to 8). It is also preferably arranged in a movable manner on, or approximately on, the central line M of the first guide contour 43.

Figure 14:
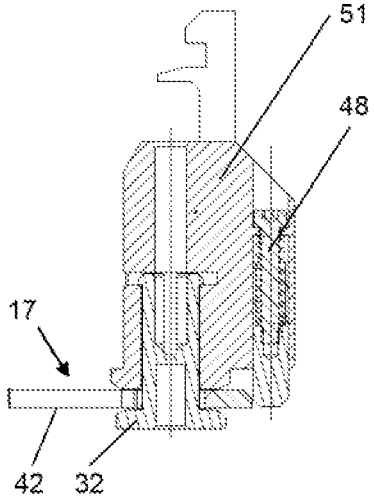
FIG. 14 shows a schematic partial sectional view of the lifting mechanism according to FIG. 13.

FIG. 14 shows a schematic partial sectional view of the lifting mechanism 17 according to FIG. 13. The spring-loaded latching bolt 48 cooperates with the guide pin 32 such that, when the washing item receptacle 12 (FIG. 9) has reached its front end position and the guide pin 32 is at the same time brought into abutment against the first guide contour 42, said latching bolt is brought into engagement outside the guide contour 42. The spring-loaded latching bolt 48 is latched outwardly beyond the guide contour 42 and at the same time fixes the washing item receptacle 12 (FIG. 9) relative to the guide mechanisms 15, 16 (FIGS. 2 to 8). The spring-loaded latching bolt 48 and the guide pin 32 may be arranged in a common unit 51.

Figure 15:
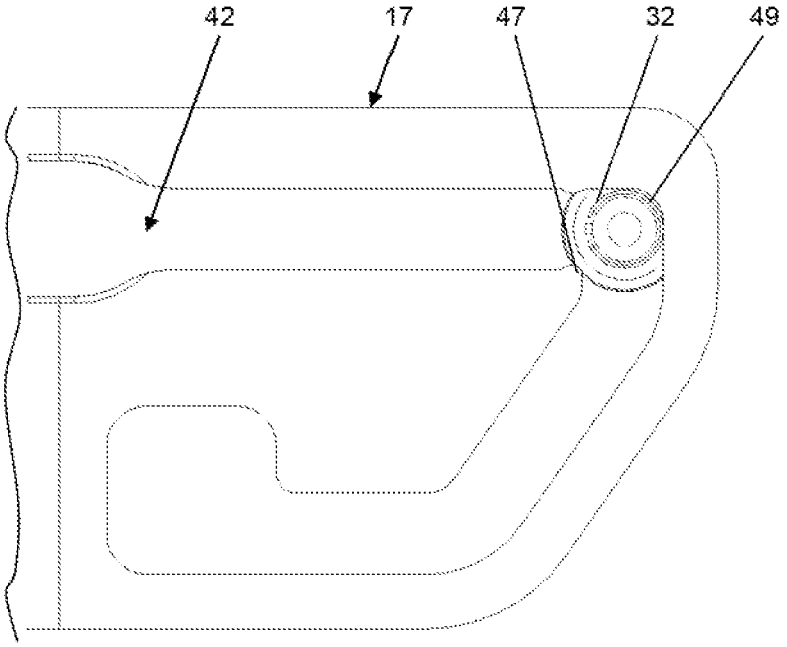
FIG. 15 shows a further schematic partial view of a lifting mechanism.

FIG. 15 shows a further schematic partial view of a lifting mechanism 17.

In this third embodiment, a spring element 49 acts on the guide pin 32. This spring element 49 ensures that the guide pin 32 is continuously supported against the guide contour 42, optionally also against a latching geometry 47, in particular a latching lug, and this leads to a fixing of the washing item receptacle 12 (FIG. 9) relative to the guide mechanisms 15, 16 (FIGS. 2 to 8).

The lifting mechanism 17 may be driven manually. The lifting mechanism 17, however, may also comprise a drive element, for example a spring, a gas compression spring, an electric motor or the like. By means of the drive element, the raising and lowering of the washing item receptacle 12 may be carried out automatically or at least may be assisted, so that the operating force applied by a user onto the washing item receptacle 12 may be reduced.

In the lifting mechanism 17 described above, no additional lever or additional arresting element is required for arresting the washing item receptacle 12. This results in reduced complexity when constructing the lifting mechanism 17. No additional elements, such as for example springs or the like, are required for locking the washing item receptacle 12. Moreover, no additional torque is exerted on the first lifting lever 18.

Whilst the present invention has been described with reference to exemplary embodiments, the invention may be modified in many different ways.

REFERENCE NUMERALS USED

1 Household dishwasher
2 Rinsing container
3 Door
4 Washing chamber
5 Pivot axis
6 Loading opening
7 Bottom
8 Ceiling
9 Rear wall
10 Side wall
11 Side wall
12 Washing item receptacle
13 Washing item receptacle
14 Washing item receptacle
15 Guide mechanism
16 Guide mechanism
17 Lifting mechanism
18 Lifting lever
19 Lifting lever
20 Guide rail
21 Guide rail
22 Guide rail
23 Pivot point
24 Pivot point
25 Pivot point
26 Pivot point
27 Base portion
28 Guide contour; guide groove
29 First guide portion
30 Second guide portion
31 Apex
32 Guide pin
33 Sliding guide
34 Shank
35 Head
36 Housing
37 Bottom support
38 Lead-in chamfer
39 Front edge
40 Front wall
41 Rear wall
42 Guide contour or guide groove
43 First guide portion
44 Second guide portion
45 Third guide portion
46 Fourth guide portion
47 Latching geometry; latching lug
48 Latching bolt
49 Spring element
50 Upper apex
51 Unit
A Withdrawal direction (arrow)
AB Spacing
AP Starting position
AW Withdrawal path
AZ Starting state
E Insertion direction (arrow)
EP End position
EZ End state
L Longitudinal direction (double arrow)
M Central line
$\alpha$ Angle of inclination
$\beta$ Angle

The invention claimed is:

1. A household dishwasher, comprising:

a rinsing container;

a washing item receptacle for receiving an item to be washed, the washing item receptacle having a guide pin;

a guide mechanism configured to move the washing item receptacle from a starting state arranged within the rinsing container to an end state arranged outside of the rinsing container and vice versa; and a lifting mechanism configured to raise the washing item receptacle from a starting position to an end position and to lower the washing item receptacle from the end position to the starting position, said lifting mechanism comprising;

a lifting lever connected in a pivotable manner to the rinsing container and the guide mechanism, the lifting lever including:

a plate-shaped base portion extending laterally therefrom, the plate-shaped base portion having a guide contour in which the guide pin is slid and guided, such that the guide contour is configured to arrest the washing item receptacle in the end position upon the washing item receptacle being lifted in a substantially linear manner from the starting position to the end position by pivoting of the lifting lever, and to arrest the washing item receptacle in the end state upon the washing item receptacle being lowered from the end position to the starting position by the pivoting of the lifting lever, wherein the guide contour is configured to guide the guide pin such that the washing item receptacle is only movable from the starting state inside the rinsing container to the end state in the starting position completely outside of the rinsing container and vice versa, substantially horizontally.

2. The household dishwasher of claim 1, wherein the guide contour is configured to guide the washing item receptacle when the washing item receptacle is raised from the starting position to the end position and when the washing item receptacle is lowered from the end position to the starting position such that a spacing between the rinsing container and the washing item receptacle is uniform.

3. The household dishwasher of claim 1, wherein the guide contour defines a maximum withdrawal path of the washing item receptacle when the washing item receptacle is moved from the starting state to the end state.

4. The household dishwasher of claim 1, wherein the guide contour has a first guide portion and a second guide portion connected to the first guide portion, said second guide portion being inclined at an angle of inclination relative to the first guide portion.

5. The household dishwasher of claim 4, wherein the first guide portion is straight and the second guide portion is straight or curved.

6. The household dishwasher of claim 4, wherein the first guide portion in the starting position is arranged parallel to the guide mechanism and in the end position is arranged perpendicular to the guide mechanism.

7. The household dishwasher of claim 4, wherein the second guide portion is arranged in the starting position and in the end position at an incline relative to the guide mechanism, wherein in the starting position the second guide portion is inclined by 90° relative to an orientation in the end position.

8. The household dishwasher of claim 1, wherein the guide contour has a first guide portion, a second guide portion connected to the first guide portion, a third guide portion connected to the second guide portion, and a fourth guide portion connected to the third guide portion.

9. The household dishwasher of claim 8, wherein the first, second, third and fourth guide portions are configured to form a U-shaped or approximately U-shaped guide contour.

10. The household dishwasher of claim 1, wherein in the starting state the guide pin is out of engagement with the guide contour, and wherein the guide pin is brought into positive engagement with the guide contour when the washing item receptacle is moved from the starting state to the end state.

11. The household dishwasher of claim 10, wherein the guide contour has a lead-in chamfer for inserting the guide pin into the guide contour when the washing item receptacle is moved from the starting state to the end state.

12. The household dishwasher of claim 1, wherein the guide contour has a first guide portion, a second guide portion connected to the first guide portion, and a latching geometry between the first guide portion and the second guide portion.

13. The household dishwasher of claim 12, wherein the latching geometry is a latching lug.

14. The household dishwasher of claim 1, further comprising a spring-loaded latching bolt which cooperates with the guide pin and is brought into engagement with the plate-shaped base portion of the lifting lever outside the guide contour.

15. The household dishwasher of claim 1, further comprising a spring element supported against the guide contour and acting on the guide pin.

16. The household dishwasher of claim 1, wherein the lifting mechanism comprises a first lifting lever having the guide contour and a second lifting lever arranged in spaced apart relation to the first lifting lever and pivotably connected to the rinsing container and the guide mechanism.

17. The household dishwasher of claim 16, wherein the guide mechanism comprises a first guide mechanism and a second guide mechanism arranged on either side of the washing item receptacle, with one pair of the first and second lifting levers being pivotably connected to the first guide mechanism and another pair of the first and second lifting levers being pivotably connected to the second guide mechanism.

18. The household dishwasher of claim 1, further comprising a first guide portion and a second guide portion connected to said first guide portion, wherein the first guide portion and the second guide portion intersect at an apex, and on condition that the guide pin bears against the apex of the guide contour, a maximum withdrawal path of the washing item receptacle is reached.

* * * * *